United States Patent [19]

Garner

[11] 4,291,666

[45] Sep. 29, 1981

[54] DRESSING TOOL FOR GRINDING WHEELS

[76] Inventor: Edward D. Garner, 4200 N. 48th St., Lincoln, Nebr. 68504

[21] Appl. No.: 96,485

[22] Filed: Nov. 21, 1979

[51] Int. Cl.[3] ..... B24B 53/08

[52] U.S. Cl. ..... 125/11 TP; 125/11 F

[58] Field of Search ..... 125/11 R, 11 TP, 11 F, 125/11 CC

[56] References Cited

U.S. PATENT DOCUMENTS

| | | | |
|---|---|---|---|
| 1,855,343 | 4/1932 | Edgar | 125/11 F |
| 2,326,073 | 8/1943 | Seyferth | 125/11 CC |
| 2,355,372 | 8/1944 | Haddad | 125/11 TP |
| 2,468,096 | 4/1949 | Miller | 125/11 TP |
| 2,469,365 | 5/1949 | Braaten | 125/11 TP |
| 2,926,653 | 3/1960 | Krafft | 125/11 TP |
| 3,008,461 | 11/1961 | Peavey | 125/11 TP |
| 3,067,733 | 12/1962 | Pernack et al. | 125/11 TP |

FOREIGN PATENT DOCUMENTS

| | | | |
|---|---|---|---|
| 204308 | 7/1939 | Switzerland | 125/11 TP |

*Primary Examiner*—Harold D. Whitehead
*Attorney, Agent, or Firm*—Morton S. Adler

[57] ABSTRACT

A diamond point type dressing tool is mounted in a control head assembly capable of producing horizontal and vertical movements of the tool either independently or simultaneously to reproduce from a remotely disposed associated template any desired contour of angles and radii on the peripheral edge of a grinding wheel. A tracing rod, snugly but slidably journalled through a fulcrum support, has a tracing end adapted for manual movement over the profile of the template and a control end operatively associated with the control head for reproducing the template profile in the movement of the dressing tool. The fulcrum support is fixed against lateral or vertical movement but has the capability of turning in place as the orientation of the axis of the rod is changed during movement over the profile. In either the horizontal or vertical movement of the control end of the rod, slidable movement of the rod through the fulcrum support serves to keep constant the distance between parallel lines through the axis of the fulcrum support and the control end of the rod. The ratio of movement of the rod control end and the tracing rod end due to the fulcrum support together with a corresponding ratio of the template profile relative to the dimensions of the edge of the wheel may be 1:1 or greater and different selected corresponding ratios are obtainable by appropriate adjustments.

9 Claims, 8 Drawing Figures

DRESSING TOOL FOR GRINDING WHEELS

BACKGROUND OF THE INVENTION

This invention relates to improvements in a dressing tool for a grinding wheel wherein a template component is utilized and more particularly to improved apparatus for transferring the template profile to a grinding wheel edge.

The use of dressing tools to form a desired contour or profile on a grinding wheel corresponding to an associated template is an old expedient and many and varied devices have been designed for such purposes. In such tools as presently used, it appears to be a common and consistent practice to form the template profile with the exact dimensions relative to those of the grinding wheel edge on a 1:1 ratio so that the tracing means for transferring the profile is, accordingly, limited to the same ratio. This requires that the template be highly accurate and that the tracing apparatus be equally accurate. It is thus apparent that should any variation or imperfection in tolerances exist either in the template profile or in the tracing apparatus, they are transferred in their full magnitude so that considerable time, labor and expense can be incurred to avoid any such result.

Accordingly, with the above observations in mind, it is one of the important objects of this invention to provide an improved dressing tool and template assembly that will assure a highly accurate reproduction of a template profile on a grinding notwithstanding the presence of a slight imperfection in the template profile.

More particularly, it is an object herein to provide a new dressing tool for grinding wheels using an associated template where the ratio of the template profile dimensions to the dimensions on the grinding wheel and the corresponding ratio of operating efficiency of the tracing apparatus may be 1:1 or greater. In this regard, the greater the ratio, the more accurate is the reproduction of the template profile on the grinding wheel since all contours of the profile including any existing imperfections thereon are reduced in magnitude on the grinding wheel by the ratio selected.

A further object is to provide a dressing tool of the above class where the availability of greater ratios as indicated affords economy and simplification in the formation of the template since any existing variation or imperfection in the exacting requirements of the desired tolerances that would normally require reworking for elimination are reduced in transfer to the grinding wheel by the ratio relationship to a point where, for all practical purposes, they become insignificant.

Another object is to provide a dressing tool as characterized which includes an improved tool control head operatively associated with the template for assuring a highly efficient and accurate reproduction on the grinding wheel of the template profile and which will require a minimum of maintenance and servicing.

The foregoing objects and such further objects as may appear herein, or be hereinafter pointed out, together with the advantages of this invention will be more fully discussed and developed in the more detailed description of the accompanying drawings.

DESCRIPTION OF THE PREFERRED EMBODIMENTS

Figure 1:
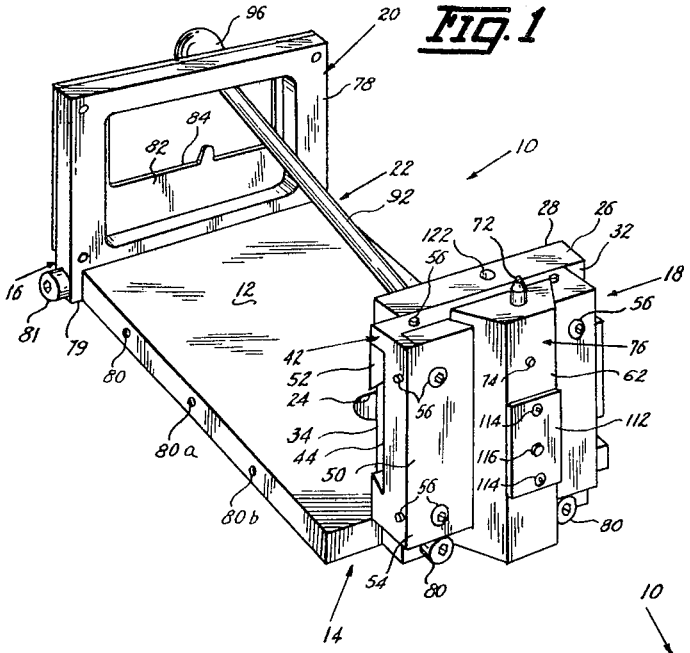
FIG. 1 is a perspective front view of this dressing tool.

Referring to the drawings, this new dressing tool is designated generally by the numeral 10 and includes a base 12 defining a forward end 14 and a rear end 16. A control head assembly 18 is carried by end 14 and a template support means 20 is arranged on end 16 or intermediate ends 14, 16 with a tracing member 22 operatively associated with assembly 18 and support 20, all of which will be referred to in more detail as this description proceeds.

Base 12 is flat to rest on any suitable support surface (not shown) and is provided with a transverse hole 24 for attachment to such support by a suitable fastening means. The control head assembly 18 is secured to base 12 and is constructed and arranged as follows, reference being made more particularly to FIG. 7.

A support shown as plate or block 26, preferably square or rectangular, is vertically disposed relative to base 12 so that the lower portion of the rear face 28 of support 26 abuts the forward end 14 of base 12 and is fixedly secured thereto by the threaded bolts 30. Such bolts and other threaded fasteners as will appear are preferably of a type to receive an Allen wrench but this is, of course, not required. The front face 32 of support 26 has the projecting horizontal dovetail shaped tenon 34 and an opening 36 extends through support 26 and tenon 34 with such opening being internally threaded 38 within support 26 and bevelled to define a ball socket 40 within tenon 34.

A horizontally or laterally slidable carriage in the form of plate or block 42 has the horizontal dovetail shaped groove 44 on its rear face 46 to mate with tenon 34 for lateral reciprocation relative thereto and is provided with the vertically disposed dovetail groove 48 on its front face 50. In a well known manner, one side of groove 46 is preferably formed by the gib 52 with a similar gib 54 forming one side of groove 48, such gibs being removably secured by appropriate threaded fasteners 56. Carriage 42 is provided with a through opening 58, bevelled as at 60 and larger than opening 36 in support 26 with which it is adapted to register.

Figure 2:
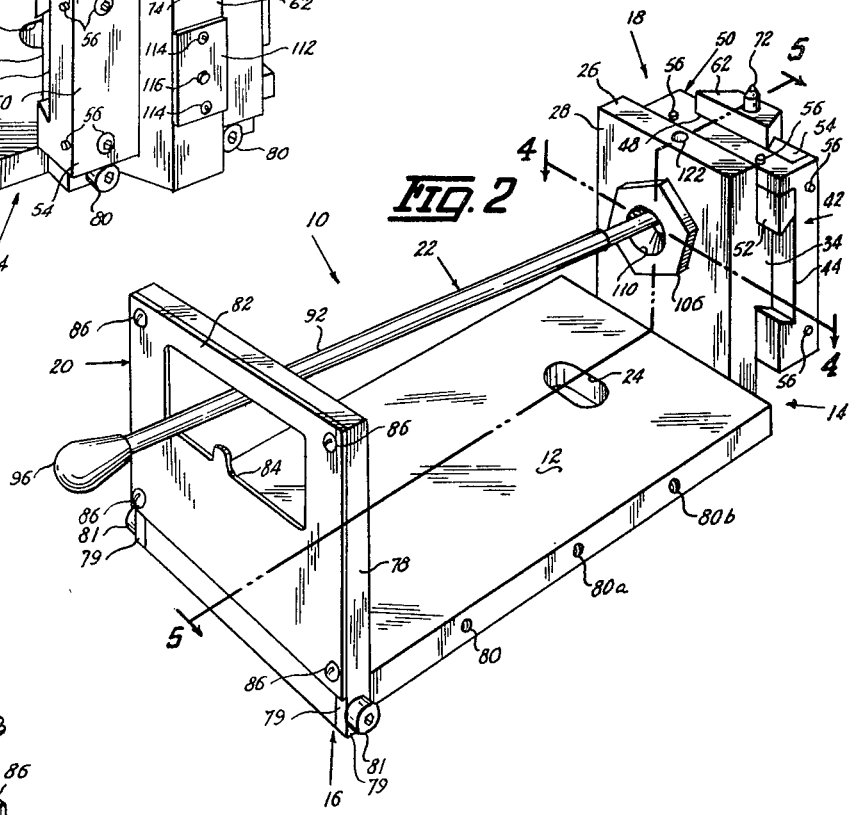
FIG. 2 is a perspective rear view thereof.

An elongated dressing tool standard or holder 62 has the shape of a dovetail tenon for reciprocal vertical movement in groove 48 on the front face 50 of carriage 42 and is provided with the through opening 64 for registration with openings 36 in support 26 and 58 in carriage 42. On the rear face 66 of standard 62, opening 64 is enlarged and bevelled as at 68. The top of standard 62 is provided with a well 70 to receive a diamond point dressing tool or the like 72 which is secured by the set screw 74 on the front face 76 of standard 62. Thus far described, with carriage 42 mounted on support 26 and standard 62 mounted in carriage 42 as best seen in FIGS. 1, 2, carriage 42 is capable of lateral or horizontal reciprocation relative to support 26 and standard 62 is capable of vertical reciprocation relative to carriage 42 and lateral reciprocation therewith. These respective movements may be independent or simultaneous and the manner, form and degree in which this can be accomplished is one of the important features of this invention, reference now being directed more particularly to FIGS. 1, 2, 4 and 5.

The template support 20 is preferably in the form of an upstanding open frame 78 having opposed depending shoulders 79 and is adapted to be removably but fixedly secured to base 12 at different selected points such as the rear end 16 as shown or at other points intermediate base ends 14, 16 illustrated at 80, 80*a* and 80*b* by the threaded bolts 81 through shoulders 79.

Figure 3:
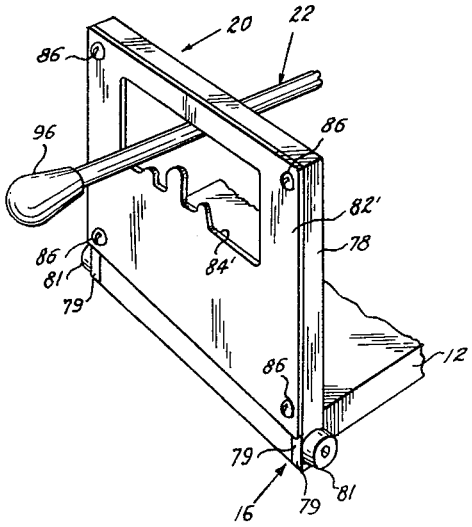
FIG. 3 is a fragmentary perspective view of template support illustrating the interchangeable use of a different profiled template.
Figure 4:
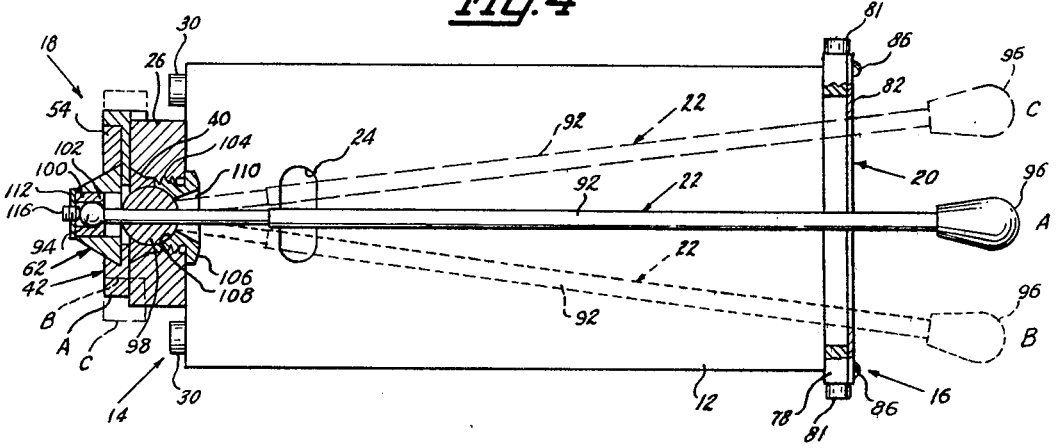
FIG. 4 is cross sectional view taken on the line 4—4 of FIG. 2 showing the different positions of the template engaging tracing rod in solid and broken lines for effecting lateral movement of the control head assembly.
Figure 5:
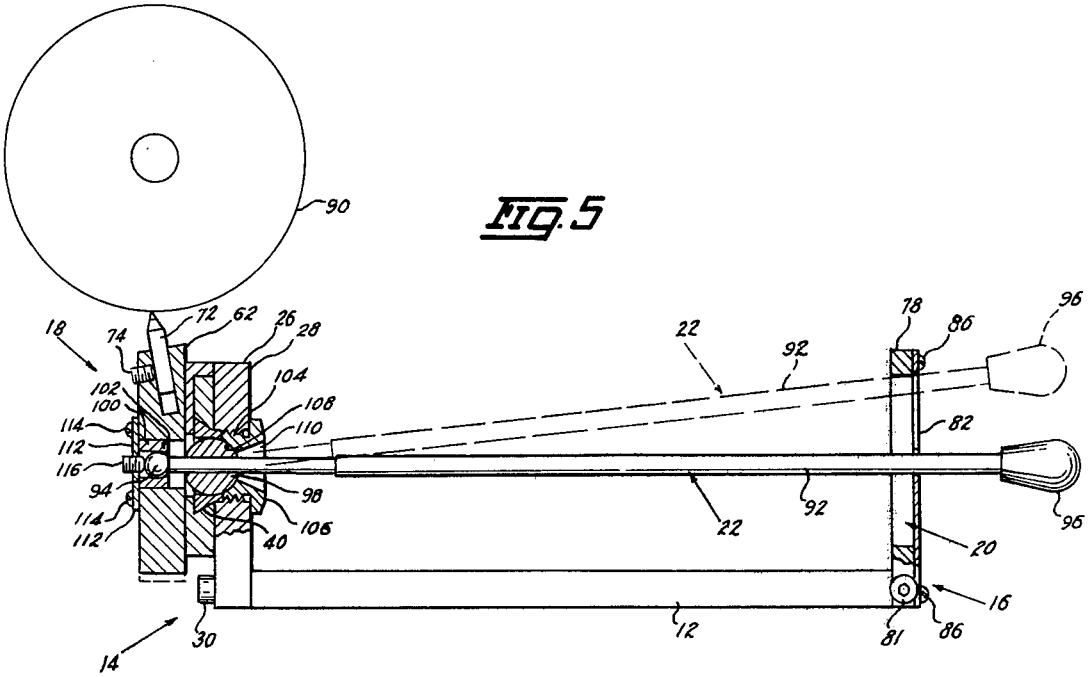
FIG. 5 is a cross sectional view taken on the line 5—5 of FIG. 2 similar to FIG. 4 relative to effecting vertical movement of the control head assembly.
Figure 6:
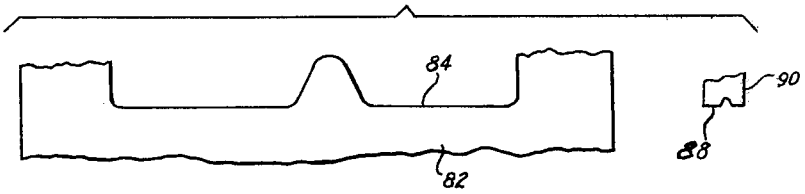
FIG. 6 is an exploded schematic view illustrating a relative ratio of 10:1 between the template profile and the reduced reproduction thereof on the peripheral edge of a grinding wheel.

A template 82 having any desired profile 84 is removably secured to frame 78 by means of screws 86 and other templates 82' with different profiles 84' (FIG. 3) may be interchanged with template 82 as desired. A highly advantageous feature of this invention resides in being able to establish the precise dimensions of the template profile 84, 84' on an enlarged scale or ratio greater than 1:1 to the corresponding profile 88 to be reproduced on the grinding wheel 90 as seen in FIG. 6 together with improved means for effecting such reduced reproduction. A preferred and satisfactory ratio is 10:1 but other ratios greater than 1:1 can be utilized as may be desired and the advantages of this arrangement will be later referred to in more detail relative to the operation of tool 10.

Manipulation of the control head assembly 18 for movement of the diamond point tool 72 in conformity with template profile 84, 84' is by means of the tracing member 22 as follows. Member 22 comprises an elongated rod 92 having a relatively small sphere or ball 94 on its forward or control end and preferably a handle or knob 96 on its rearward or tracing end. Intermediate such ends, rod 92 is snugly journalled through a fulcrum support in the form of a larger sphere or ball 98 but capable of slidable movement relative thereto. Sphere 98 may be arranged at any selected point on rod 92 for a desired ratio of movement between the tracing and control ends thereof but, preferably, I fix it at a point in close proximity for a 10:1 ratio which can be varied as will appear by different positions of frame 78 and template 82 relative to base 12 and it will be understood that a similar ratio adjustment could be obtained by keeping the frame 78 fixed and varying the position of fulcrum support 98.

Thus far described and with support 26, carriage 42 and standard 62 arranged so that their respective openings 36, 58 and 64 are in register, rod 92 is disposed so that knob 96 extends rearwardly through frame 78 as seen in FIGS. 1, 2 where the tracing end portion of rod 92 can engage template profile 84, 84' and the sphere or ball 94 at the control end of rod 92 is seated in opening 64 of standard 62, said opening being provided with a bushing 100 having a lipped end 102 at the rear face 66 of standard 62 to abut sphere 94. As sphere 94 is thus positioned, the fulcrum support sphere 98 will seat in socket 40 in support 26. An externally threaded sleeve 104 having a bore larger than the diameter of rod 92 is journalled on such rod and has an integral enlarged hex head 106 on one end with the opposite end bevelled 108 to complement bevel 40 whereby threadable engagement of sleeve 104 with threads 38 in opening 36 secures sphere 98 and rod 92 to assembly 18. In this arrangement, hex head 106 tightens against the rear face 28 of support 26 and head 106 is provided with an axial opening 110 to register with the bore of sleeve 104 and of sufficient diameter to permit free movement of rod 92 in any direction. On the front face 76 of standard 62, opening 64 is covered by plate 112 secured by screws 114 to form a socket for ball 94 and carries a set screw 116 to bear against such ball 94 for preventing any longitudinal movement thereof relative to bushing 100. It should be noted here that plate 112 and set screw 116 may be eliminated so long as means are provided to prevent longitudinal movement of sphere 94 such as by forming opening 64 as a well communicating with face 66 of standard 62 or the like.

Figure 7:
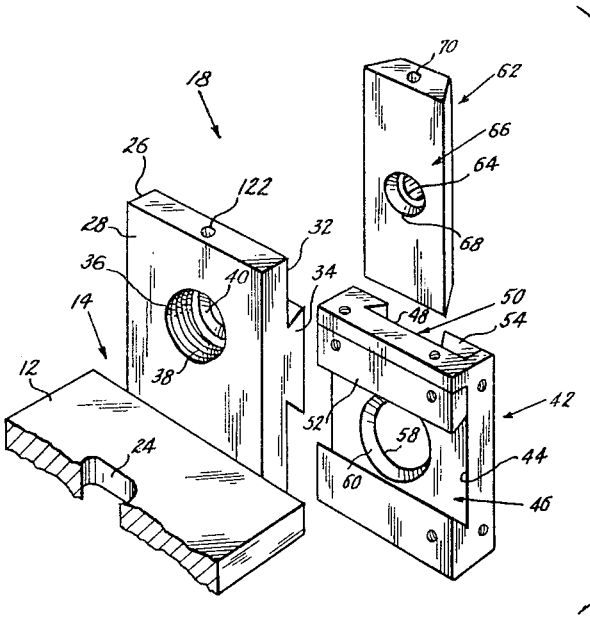
FIG. 7 is an exploded perspective view of the control head assembly.

In the attachment of rod 92 to the control head assembly 18 as just described, it is pointed out that the fulcrum sphere 98 is effectively locked into support 26 against any lateral or vertical movement capability but remains capable of being turned or partially rotated or revolved in place in response to movements of rod 92 changing the orientation of the axial line thereof. The sphere 94, due to the appropriate dimensions of bushing 100 for engaging the same and the set screw 116, is also effectively locked against any independent lateral or vertical movement relative to standard 62 so that any vertical movement of sphere 94 resulting from position changes of fulcrum support 98 is precisely transferred to standard 62 and similarly produced lateral movement of sphere 94 is similarly transferred through standard 62 to carriage 42. It will be understood that while sphere 94 is locked against independent lateral or vertical movement relative to standard 62 as described, it will turn in place similarly to sphere 98 as the orientation of the axis of rod 92 changes and such movement by rod 92 intermediate spheres 94, 98 is accommodated in standard 62 by bevel 68 and in carriage 42 by bevel 60. Likewise, such movement of rod 92 relative to support 26 is accommodated by opening 110 in hex head 106 as best seen in FIG. 7.

OPERATION

Figure 8:
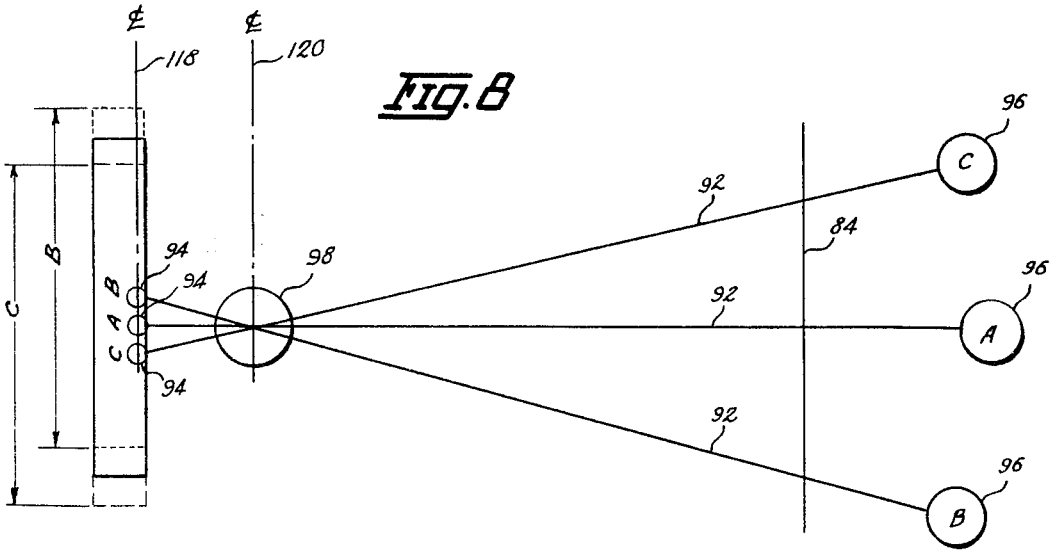
FIG. 8 is a schematic view, for purposes of illustration on a scale of 5:1, to show the operation of the tracing rod relative to the template and the control head assembly.

While this invention discloses an improved dressing tool apparatus for transferring a template profile to a grinding wheel in the conventional manner of a 1:1 ratio between the template profile and the wheel, one of the advantages of this invention is its capability in transferring a template profile made on an enlarged scale to a corresponding profile on a reduced scale on a grinding wheel and, accordingly, tool 10 is shown with tracing member 20 disposed and arranged for relative movement of the tracing rod end and the control end through the fulcrum support 98 at a ratio of 10:1, it being understood that for such purposes, the template profile 84 is enlarged relative to the profile on wheel 90 by the same ratio and that frame 78 will be secured to the rear end 16 of base 12. Ratios greater than 10:1 are not deemed necessary to assure satisfactory accuracy although, if desired, they can be obtained by suitable obvious modifications. Ratios less than 10:1 on profile 84 can be accurately reproduced by moving frame 78 to a selected corresponding ratio for rod 92 such as at positions 80, 80*a* or 80*c* and the like. Reference is now made to FIG. 8 where the tracing member 20 and the template profile 84 are schematically shown on a scale of 5:1 for purposes of illustrating their operation.

The rod 92, held at handle 96 and maintained in contact with profile 84 can be moved across the profile as representated by positions A, B and C. Such rod movement causes the fulcrum support 98 to turn in place changing the orientation of the axis of rod 92 so that control end 94 moves to corresponding positions A, B and C. In these movements, end 94 being secured against standard 62 as described will effect an appropriate reverse vertical movement thereof and of tool 72 in response to vertical movement of rod end portion 96 on profile 84 and, likewise, a corresponding lateral movement of tool 72 is effected by movement to the slidable carriage 42 through the attached standard 62. While handle end 96 moves in an arc as rod 92 travels over profile 84, control end 94 moves in the same plane both vertically and horizontally and this is illustrated for horizontal movement by center line 118 through the axis of end 94 and the parallel center line 120 through the axis of the fulcrum support 98. The distance between lines 118, 120 remains constant as end 94 moves standard 62 and carriage 42 to different lateral positions and this is accomplished by rod 92 slidably moving through the sphere 98 as end 94 moves away from its shortest distance from sphere 98 at position A to greater distances therefrom represented at positions B and C. Comparable constant distance as between center lines 118, 120 is likewise maintained in the same manner during vertical movement of rod 94 away from a horizontal plane of the axis of rod 92.

It will thus be understood from the above that tool 72 can move vertically or laterally either independently or simultaneously in conformity with the outline of the profile 84 and that irrespective of the ratio selected for tracing member 20 and profile 84, the rod 92 journalled through the fixed fulcrum support 98 and arranged for rod control end 94 to move in the same plane, affords a materially improved apparatus for accurate reproduction of profile 84 on wheel 90. Should an operator inadvertently elevate rod 92 from contact with profile 84, no damage is done and re-movement of the rod over the profile portion missed will transfer the appropriate movement to tool 72. For lubrication of fulcrum support 98, an oil passageway 122 is provided in support 26 as shown.

The fullest advantage in this new tool will be obtained by using it with template profile and tracing member ratios relative to the grinding wheel greater than 1:1 and preferably in the range of 10:1 in obtaining satisfactory accuracy in transferring the profile to the wheel for all of the reasons hereinabove mentioned. Accordingly, in view of the foregoing, it is thought a full understanding of the construction and operation of this invention will be had and the advantages of the same will be appreciated.

I claim:

1. A grinding wheel dresser, comprising:

a fixed first member, a second member slidably mounted on said first member for lateral reciprocation relative thereto, a third member adapted to hold a dressing tool and slidably mounted on said second member for vertical reciprocation relative thereto and lateral reciprocation therewith, said third member adapted to selectively move laterally with said second member without vertical reciprocation and to move vertically relative thereto simultaneously with the lateral reciprocation thereof, a template with a predetermined profile, means for mounting said template in a predetermined spaced relationship from said first member, an elongated tracing rod having a first end and a second end, means extending said first end through said first and second members free of engagement therewith and into said third member, means for engaging said first end with said third member against independent movement relative thereto, a fulcrum support on said rod, means securing said fulcrum support against vertical and horizontal movement but retaining capability for said fulcrum support to turn in place, said rod arranged for slidable movement relative to said fulcrum support, said second end of said rod disposed and adapted for manual movement in contact with said template profile whereby said first end acts against said third member and effects action against said second member to reproduce the template profile by a dressing tool secured to said third member, and the sliding capability of said rod relative to said fulcrum support serving to maintain all lines of movement of said first end correspondingly planar with lines of movement of said second and third members as the orientation of the axis of said rod changes.

2. A grinding wheel dresser as defined in claim 1, including:

the dimensions of said template profile being enlarged over the actual dimensions of a profile to be reproduced on a grinding wheel by a predetermined ratio greater than 1:1, and said fulcrum support being positioned on said rod to effect an operating efficiency as between said first end and said second end of the same ratio selected for said template profile.

3. A grinding wheel dresser as defined in claim 2 wherein said ratio is 10:1.

4. A grinding wheel dresser as defined in claims 1, 2 or 3, including:

a base, said first member secured to said base, said fulcrum support being fixed on said rod at a point defining an operating efficiency as between said first and second ends at a ratio greater than 1:1, said fulcrum support secured in said first member against vertical and horizontal movement relative thereto but capable of turning in place, a template support frame, a template with a profile enlarged to a predetermined ratio greater than 1:1 relative to the actual profile to be reproduced therefrom on a grinding wheel, means for releasably securing said template to said frame, and means for releasably securing said frame at selected points on said base in spaced relationship to said first member and at a point relative to said rod to effect an operating efficiency thereof corresponding to the selected template profile ratio.

5. A grinding wheel dresser as defined in claim 4 including said fulcrum support being a sphere.

6. A grinding wheel dresser as defined in claim 4 including said first end of said rod defined by a sphere.

7. A grinding wheel dresser, comprising:

a base having a forward and a rear end, a support fixedly mounted to said forward end, a carriage slidably mounted on said support for lateral reciprocation relative thereto, a dressing tool standard slidably mounted on said carriage for vertical reciprocation relative thereto and lateral reciprocation therewith, said standard adapted to selectively move laterally with said carriage without vertical reciprocation and to move vertically relative thereto simultaneously with the lateral reciprocation thereof, means on said standard for holding a dressing tool, said support, carriage and standard being provided with respective openings capable of being in registration, the opening in said support defining a first ball socket and the opening in said standard defining a second ball socket, a template with a predetermined profile removably mounted on the rear end of said base, an elongated rod having a first end and a second end, a first ball in said first ball socket and a second ball on said first end of said elongated rod, said rod being snugly but slidably journalled through said first ball with said first ball disposed in close proximity to said first end, means for engaging said second ball with said second ball socket against independent movement relative thereto, means for securing said first ball in said first ball socket against any lateral and vertical movement relative thereto but retaining the capability of said first ball to turn in place, said second end of said rod adapted for manual movement over and in contact with the profile of said template whereby movement of said rod over said template profile causes said first ball to turn in place in response to changes in the orientation of the axis of said rod so that said second ball effects responsive movements in said carriage and said standard in transferring said profile to corresponding movements of said dressing tool, and the respective distances between parallel vertical lines and between parallel horizontal lines extending respectively through the axes of said first ball and said second ball remaining constant by slidable movement of said rod through said first ball as said second ball is moved laterally and vertically in response to movement of said second end.

8. A grinding wheel dresser as defined in claim 7, including:

the dimensions of said template profile being enlarged over the actual dimensions of a profile to be reproduced on a grinding wheel by a predetermined ratio greater than 1:1, and the position of said first ball on said rod defining an operating efficiency ratio as between said first and second ends corresponding to the ratio selected for said template profile.

9. A grinding wheel dresser as defined in claims 7 or 8, including:

a template support frame, means for releasably securing said template to said frame, and means to releasably secure said frame at selected points on said base to position different respective templates with different selected profile ratios so that the operating ratio of said rod corresponds thereto.

* * * * *